US006843560B2

(12) United States Patent
Romano, Jr. et al.

(10) Patent No.: US 6,843,560 B2
(45) Date of Patent: Jan. 18, 2005

(54) INK JET PRINTING METHOD

(75) Inventors: Charles E. Romano, Jr., Rochester, NY (US); Amanda R. Broska, Rochester, NY (US); Eric L. Boyle, Penfield, NY (US); Kevin Dockery, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/213,946

(22) Filed: Aug. 7, 2002

(65) Prior Publication Data

US 2004/0027438 A1 Feb. 12, 2004

(51) Int. Cl.[7] ..... B41J 2/01
(52) U.S. Cl. ..... 347/105; 347/101; 347/100; 428/32.1
(58) Field of Search ..... 347/105, 100, 347/101, 96, 1; 428/195, 32.1, 98, 178, 103, 187, 189; 346/135.1

(56) References Cited

U.S. PATENT DOCUMENTS 5,856,023 A * 1/1999 Chen et al. ..... 347/105
5,942,335 A 8/1999 Chen et al.
6,214,458 B1 * 4/2001 Kobayashi et al. ..... 428/195
6,224,971 B1 * 5/2001 Tomizawa et al. ..... 428/195
6,372,329 B1 * 4/2002 Graczyk et al. ..... 428/195

* cited by examiner

*Primary Examiner*—Stephen D. Meier
*Assistant Examiner*—Manish Shah
(74) *Attorney, Agent, or Firm*—Harold E. Cole; Chris P. Konkol

(57) ABSTRACT

An ink jet printing method having the steps of: A) providing an ink jet printer that is responsive to digital data signals; B) loading the printer with an ink jet recording element having a support having thereon, in order, a hydrophilic absorbing layer and a polymeric overcoat layer of a derivitized poly (vinyl alcohol) having at least one hydroxyl group replaced by ether or ester groups, the polymeric overcoat layer also containing a sulfurous acid salt and an ammonium salt; C) loading the printer with an ink jet ink; and D) printing on the image-receiving layer using the ink jet ink in response to the digital data signals.

20 Claims, No Drawings

INK JET PRINTING METHOD

CROSS REFERENCE TO RELATED APPLICATIONS

Reference is made to commonly assigned, co-pending U.S. patent applications:

Ser. No. 10/068,824 by Charles E. Romano, Jr., filed Feb. 6, 2002, entitled "Ink Recording Element"; and Ser. No. 10/214,028 by Charles E. Romano, Jr. et al filed Aug. 07, 2002 entitled "Ink Jet Recording Element".

FIELD OF THE INVENTION

The present invention relates to an ink jet printing method.

BACKGROUND OF THE INVENTION

In a typical ink jet recording or printing system, ink droplets are ejected from a nozzle at high speed towards a recording element or medium to produce an image on the medium. The ink droplets, or recording liquid, generally comprise a recording agent, such as a dye or pigment, and a large amount of solvent. The solvent, or carrier liquid, typically is made up of water, an organic material such as a monohydric alcohol, a polyhydric alcohol or mixtures thereof.

An ink recording element typically comprises a support having on at least one surface thereof an ink-receiving or image-forming layer, and includes those intended for reflection viewing, which have an opaque support, and those intended for viewing by transmitted light, which have a transparent support.

In order to achieve and maintain high quality images on such an image-recording element, the recording element must:

Exhibit no banding, bleed, coalescence, or cracking in inked areas.

Exhibit the ability to absorb large amounts of ink and dry quickly to avoid blocking.

Exhibit high optical densities in the printed areas.

Exhibit freedom from differential gloss.

Have high levels of image fastness to avoid fade from contact with water or radiation by daylight, tungsten light, or fluorescent light.

Have excellent adhesive strength so that delamination does not occur.

While a wide variety of different types of image recording elements for use with ink printing are known, there are many unsolved problems in the art and many deficiencies in the known products, which have severely limited their commercial usefulness. A major challenge in the design of an image-recording element is laminate adhesion. A typical coating from the prior art comprises a layer containing hydroxypropylmethyl cellulose, hydroxyethyl cellulose and a vinyl latex polymer, a layer of pectin, a layer of poly(vinyl alcohol) and polyurethane, and a layer of lime processed osseine gelatin in the order recited. This formulation has demonstrated poor laminate adhesion.

U.S. Pat. Nos. 5,942,335 and 5,856,023 relate to an ink jet receiving layer containing a mixture of derivitized and underivitized poly(vinyl alcohol) and poly(vinylbenzyl quaternary ammonium salt) with or without polyvinyl pyrrolidinone. However, there is a problem with this element in that the keeping stability is not as good as one would like.

It is an object of this invention to provide an ink jet printing method using a multilayer ink recording element that has excellent image quality, better laminate adhesion and keeping stability than elements of the prior art.

SUMMARY OF THE INVENTION

These and other objects are achieved by the present invention which comprises an ink jet printing method, comprising the steps of:

A) providing an ink jet printer that is responsive to digital data signals;

B) loading the printer with an ink jet recording element comprising a support having thereon, in order, a hydrophilic absorbing layer and a polymeric overcoat layer comprising a derivitized poly(vinyl alcohol) having at least one hydroxyl group replaced by ether or ester groups, the polymeric overcoat layer also containing a sulfurous acid salt and an ammonium salt;

C) loading the printer with an ink jet ink; and

D) printing on the image-receiving layer using the ink jet ink in response to the digital data signals.

The ink jet elements obtained using the printing method of the invention have excellent image quality, good laminate adhesion and keeping stability.

DETAILED DESCRIPTION OF THE INVENTION

The hydrophilic absorbing layer that may be used in the invention comprises a natural or synthetic polymer. Preferred is a hydrophilic absorbing layer comprising gelatin or poly (vinyl alcohol) (PVA). This layer may also contain other hydrophilic materials such as naturally-occurring hydrophilic colloids and gums such as albumin, guar, xantham, acacia, chitosan, starches and their derivatives, functionalized proteins, functionalized gums and starches, and cellulose ethers and their derivatives, polyvinyloxazoline, such as poly(2-ethyl-2-oxazoline) (PEOX), polyvinylmethyloxazoline, polyoxides, polyethers, poly(ethylene imine), poly(acrylic acid), poly(methacrylic acid), n-vinyl amides including polyacrylamide and polyvinyl pyrrolidinone (PVP), and poly(vinyl alcohol) derivatives and copolymers, such as copolymers of poly(ethylene oxide) and poly(vinyl alcohol) (PEO-PVA). The gelatin used in the present invention may be made from animal collagen, but gelatin made from pig skin, cow skin, or cow bone collagen is preferable due to ready availability. The kind of gelatin is not specifically limited, but lime-processed gelatin, acid processed gelatin, amino group inactivating gelatin (such as acetylated gelatin, phthaloylated gelatin, malenoylated gelatin, benzoylated gelatin, succinylated gelatin, methyl urea gelatin, phenylcarbamoylated gelatin, and carboxy modified gelatin), or gelatin derivatives (for example, gelatin derivatives disclosed in JP Patent publications 38-4854/1962, 39-5514.1964, 40-12237/1965, 42-26345/1967 and 2-13595/1990, U.S. Pat. Nos. 2,525,753; 2,594,293; 2,614,928; 2,763,639; 3,118,766; 3,132,945; 3,186,846; 3,312,553 and GB Patents 861,414 and 103, 189) can be used singly or in combination. Most preferred are pigskin or modified pigskin gelatins and acid processed osseine gelatins due to their effectiveness for use in the present invention.

The hydrophilic absorbing layer must effectively absorb both the water and humectants commonly found in printing inks. In a preferred embodiment of the invention, two hydrophilic absorbing layers are present, one comprising gelatin, and the other comprising hydrophilic materials such as naturally-occurring hydrophilic colloids and gums such as albumin, guar, xantham, acacia, chitosan, starches and their derivatives, functionalized proteins, functionalized gums and starches, and cellulose ethers and their derivatives, polyvinyloxazoline, such as poly(2-ethyl-2-oxazoline) (PEOX), non-modified gelatins, polyvinylmethyloxazoline, polyoxides, polyethers, poly(ethylene imine), n-vinyl amides including polyacrylamide and polyvinyl pyrrolidinone (PVP), and poly(vinyl alcohol) derivatives and copolymers, such as copolymers of poly(ethylene oxide) and poly(vinyl alcohol) (PEO-PVA), polyurethanes, and polymer latices such as polyesters and acrylates. In another preferred embodiment of the invention, the hydrophilic absorbing layers comprise a base layer comprising gelatin and at least one upper layer, also referred to as an inner layer, located between the hydrophilic absorbing gelatin layer, and the absorbing hydrophilic overcoat polymer layer. These embodiments provide enhanced image quality. The inner layer typically comprises a mixture of poly(vinyl alcohol) and a polyurethane dispersion, such as Witcobond® 232, in a ratio of about 50:50 to about 95:5 PVA to polyurethane. The hydrophilic materials employed in the second hydrophilic absorbing layer or inner layer may be present in any amount that is effective for the intended purpose. In general, the dry layer thickness of the gelatin layer is from about 5 to 60 microns, below which the layer is too thin to be effective and above which no additional gain in performance is noted with increased thickness. The dry layer thickness of the poly(vinyl alcohol)/Witcobond® 232 inner layer is from about 0.5 to 5 $\mu$m.

The derivitized poly(vinyl alcohol) having at least one hydroxyl group replaced by ether or ester groups which may be used in the invention may comprise an acetoacetylated poly(vinyl alcohol) in which the hydroxyl groups are esterified with acetoacetic acid having an average molecular weight of from about 15,000 to 150,000, a saponification degree (mol %) of from about 80–100%, and a modification degree (mol %) of from about 2.5–15%. These PVA compounds are readily available and effective with the present invention.

Sulfurous acid salts which may be used in the invention include sulfites ($XYSO_3$, where X and Y are preferentially but not necessarily, alkali metals), hydrogen sulfites (i.e., bisulfites, $XHSO_3$, where X is preferentially but not necessarily an alkali metal), and pyrosulfites ($XYS_2O_5$, where X and Y are defined as above). The sulfurous acid salts may be added as solids or as solutions, and they may be used in any combination.

The ammonium salts useful in the invention may have the formula $$(NR^1R^2R^3R^4)Z,$$

where $R^1$, $R^2$, $R^3$, and $R^4$ are hydrogen or alkyl, with the proviso that at least one $R^1$, $R^2$, $R^3$, or $R^4$ is hydrogen; and Z is a counterion.

The ammonium salts may be incorporated with the sulfurous acid salts, e.g., ammonium sulfite ($(NH_4)_2SO_3$), or added separately, e.g., as ammonium chloride ($NH_4Cl$). The ammonium salts may be added as solids or as solutions and may be used in any combination. In the preferred embodiment of the invention, the sulfurous acid salt sodium metabisulfite ($Na_2S_2O_5$) and the ammonium salt ammonium chloride ($NH_4Cl$) are used. Each of these salts may be used in the overcoat layer in an amount of from about 1 to about 8 wt. %.

The overcoat layer may also contain polyurethanes or vinyl latex polymers and other hydrophilic materials such as cellulose derivatives, e.g., cellulose ethers like methyl cellulose (MC), ethyl cellulose, hydroxypropyl cellulose (HPC), sodium carboxymethyl cellulose (CMC), calcium carboxymethyl cellulose, methylethyl cellulose, methylhydroxyethyl cellulose, hydroxypropylmethyl cellulose (HPMC), hydroxybutylmethyl cellulose, ethylhydroxyethyl cellulose, sodium carboxymethyl-hydroxyethyl cellulose, and carboxymethylethyl cellulose, and cellulose ether esters such as hydroxypropylmethyl cellulose phthalate, hydroxypropylmethyl cellulose acetate succinate, hydroxypropyl cellulose acetate, esters of hydroxyethyl cellulose and diallyldimethyl ammonium chloride, esters of hydroxyethyl cellulose and 2-hydroxypropyltrimethylammonium chloride and esters of hydroxyethyl cellulose and a lauryldimethylammonium substituted epoxide (HEC-LDME), such as Quatrisoft® LM200 (Amerchol Corp.) as well as hydroxyethyl cellulose grafted with alkyl $C_{12}$–$C_{14}$ chains, naturally-occurring hydrophilic colloids and gums such as albumin, guar, xantham, acacia, chitosan, starches and their derivatives, functionalized proteins, functionalized gums and starches, and cellulose ethers and their derivatives, polyvinyloxazoline, such as poly(2-ethyl-2-oxazoline) (PEOX), modified or non-modified bone or pigskin gelatins, polyvinylmethyloxazoline, polyoxides, polyethers, poly (ethylene imine), n-vinyl amides including polyacrylamide and polyvinylpyrrolidinone (PVP), and poly(vinyl alcohol) derivatives and copolymers, such as copolymers of poly (ethylene oxide) and poly(vinyl alcohol) (PEO-PVA).

In a preferred embodiment of the invention, the overcoat layer comprises a mixture of acetoacetylated poly(vinyl alcohol), sodium metabisulfite and ammonium chloride. The preferred dry coverage of the overcoat layer is from about 0.5 to 5 $\mu$m as is common in practice.

Matte particles may be added to any or all of the layers described in order to provide enhanced printer transport, resistance to ink offset, or to change the appearance of the ink receiving layer to satin or matte finish. In addition, surfactants, defoamers, or other coatability-enhancing materials may be added as required by the coating technique chosen.

Typically, dye mordants are added to image-receiving layer in order to improve water and humidity resistance. However, most mordant materials adversely affect dye light stability. Any polymeric mordant can be used in the ink recording layer of the invention provided it does not adversely affect light fade resistance. For example, there may be used a cationic polymer, e.g., a polymeric quaternary ammonium compound, or a basic polymer, such as poly (dimethylaminoethyl)-methacrylate, polyalkylenepolyamines, and products of the condensation thereof with dicyanodiamide, amine-epichlorohydrin polycondensates, lecithin and phospholipid compounds. Examples of mordants useful in the invention include vinylbenzyl trimethyl ammonium chloride/ethylene glycol dimethacrylate, vinylbenzyl trimethyl ammonium chloride/divinyl benzene, poly(diallyl dimethyl ammonium chloride), poly(2-N,N,N-trimethylammonium)ethyl methacrylate methosulfate, poly(3-N,N,N-trimethylammonium)propyl methacrylate chloride, a copolymer of vinylpyrrolidinone and vinyl(N-methylimidazolium chloride, and hydroxyethyl cellulose derivitized with (3-N,N,N-trimethylammonium) propyl chloride.

The support for the ink recording element used in the invention can be any of those usually used for ink jet receivers, such as resin-coated paper, paper, polyesters, or microporous materials such as polyethylene polymer-containing material sold by PPG Industries, Inc., Pittsburgh, Pa. under the trade name of Teslin®, Tyvek® synthetic paper (DuPont Corp.), impregnated paper such as Duraform®, and OPPalyte® films (Mobil Chemical Co.) and other composite films listed in U.S. Pat. No. 5,244,861. Opaque supports include plain or calendered paper, coated paper, paper coated with protective polyolefin layers, synthetic paper, photographic paper support, melt-extrusion-coated paper, and laminated paper, such as biaxially oriented support laminates. Biaxially oriented support laminates are described in U.S. Pat. Nos. 5,853,965; 5,866,282; 5,874,205; 5,888,643; 5,888,681; 5,888,683; and 5,888,714, the disclosures of which are hereby incorporated by reference. These biaxially oriented supports include a paper base and a biaxially oriented polyolefin sheet, typically polypropylene, laminated to one or both sides of the paper base. Transparent supports include glass, cellulose derivatives, e.g., a cellulose ester, cellulose triacetate, cellulose diacetate, cellulose acetate propionate, cellulose acetate butyrate, polyesters, such as poly(ethylene terephthalate), poly(ethylene naphthalate), poly(1,4-cyclohexanedimethylene terephthalate), poly(butylene terephthalate), and copolymers thereof, polyimides, polyamides, polycarbonates, poly(vinyl chloride), polystyrene, polyolefins, such as polyethylene or polypropylene, polysulfones, polyacrylates, polyetherimides, and mixtures thereof. The papers listed above include a broad range of papers, from high end papers, such as photographic paper to low end papers, such as newsprint. In particular, polyethylene-coated paper or poly (ethylene terephthalate) are preferred and are commonly used in imaging applications.

The support used in the invention may have a thickness of from about 50 to about 500 $\mu$m, preferably from about 75 to 300 $\mu$m to provide acceptable look and feel as well as effectiveness in the present invention. Antioxidants, antistatic agents, plasticizers and other known additives may be incorporated into the support, if desired.

In order to improve the adhesion of the ink recording layer to the support, the surface of the support may be subjected to a corona-discharge treatment prior to applying the ink recording layer. The adhesion of the ink recording layer to the support may also be improved by coating a subbing layer on the support. Examples of materials useful in a subbing layer include halogenated phenols and partially hydrolyzed vinyl chloride-co-vinyl acetate polymer. In order to impart mechanical durability to an ink recording element, crosslinkers, which act upon the binder discussed above, may be added in small quantities. Such an additive improves the cohesive strength of the layer. Crosslinkers such as carbodiimides, polyfunctional aziridines, aldehydes, isocyanates, epoxides, polyvalent metal cations, and the like may all be used.

To improve colorant fade, UV absorbers, radical quenchers or antioxidants may also be added to the ink recording layer as is well known in the art. Other additives include pH modifiers, adhesion promoters, rheology modifiers, surfactants, biocides, lubricants, dyes, optical brighteners, matte agents, antistatic agents, etc. In order to obtain adequate coatability, additives known to those familiar with such art such as surfactants, defoamers, alcohol and the like may be used. A common level for coating aids is 0.01 to 0.30 wt. % active coating aid based on the total solution weight. These coating aids can be nonionic, anionic, cationic or amphoteric. Specific examples are described in MCCUTCHEON's Volume 1: Emulsifiers and Detergents, 1995, North American Edition.

In another embodiment of the invention, a filled layer containing light scattering particles such as titania may be situated between a clear support material and the ink receptive multilayer described herein. Such a combination may be effectively used as a backlit material for signage applications. Yet another embodiment which yields an ink receiver with appropriate properties for backlit display applications results from selection of a partially voided or filled poly (ethylene terephthalate) film as a support material, in which the voids or fillers in the support material supply sufficient light scattering to diffuse light sources situated behind the image.

Optionally, an additional backing layer or coating may be applied to the backside of a support (i.e., the side of the support opposite the side on which the image-recording layers are coated) for the purposes of improving the machine-handling properties and curl of the recording element, controlling the friction and resistivity thereof, and the like.

While not necessary, the hydrophilic material layers described above may also include a crosslinker. Such an additive can improve the adhesion of the ink receptive layer to the substrate as well as contribute to the cohesive strength and water resistance of the layer. Crosslinkers such as carbodiimides, polyfunctional aziridines, melamine formaldehydes, isocyanates, epoxides, and the like may be used. If a crosslinker is added, care must be taken that excessive amounts are not used as this will decrease the swellability of the layer, reducing the drying rate of the printed areas.

Coating compositions employed in the invention may be applied by any number of well known techniques, including dip-coating, wound-wire rod coating, doctor blade coating, gravure and reverse-roll coating, slide coating, bead coating, extrusion coating, curtain coating and the like. Known coating and drying methods are described in further detail in Research Disclosure no. 308119, published December 1989, pages 1007 to 1008. Slide coating is preferred, in which the base layers and overcoat may be simultaneously applied. After coating, the layers are generally dried by simple evaporation, which may be accelerated by known techniques such as convection heating. Slide coating, in which the base layers and overcoat may be simultaneously applied is preferred as cost effective as well as useful in the present invention.

Inks used to image the recording elements employed in the present invention are well-known in the art. The ink compositions used in inkjet printing typically are liquid compositions comprising a solvent or carrier liquid, dyes or pigments, humectants, organic solvents, detergents, thickeners, preservatives, and the like. The solvent or carrier liquid can be solely water or can be water mixed with other water-miscible solvents such as polyhydric alcohols. Inks in which organic materials such as polyhydric alcohols are the predominant carrier or solvent liquid may also be used. Particularly useful are mixed solvents of water and polyhydric alcohols. The dyes used in such compositions are typically water-soluble direct or acid type dyes. Such liquid compositions have been described extensively in the prior art including, for example, U.S. Pat. No. 4,381,946, U.S. Pat. No. 4,239,543 and U.S. Pat. No. 4,781,758.

The following example is provided to illustrate the invention.

EXAMPLE

Control Element C-1

A polyethylene resin coated paper was treated by corona discharge and coated by means of a slide hopper with a 17% gelatin solution in water, (succinylated pigskin gelatin, Kind & Knox Gelatine Co.), and 0.4% 12–14 $\mu$m polystyrene beads, dry coverage of about 7.1 μm and an inner layer of 5% solution of Elvanol® 52-22 poly(vinyl alcohol) (DuPont) and a 30% dispersion of Witcobond® 232 polyurethane (Witco Corp), where the poly(vinyl alcohol) (PVA) and polyurethane dispersion (PUD) were mixed in a 77:23 ratio by weight at a dry coverage of 1.5 μm.

An overcoat layer consisting of a 7% solution of Z-320 acetoactylated poly(vinyl alcohol) (Nippon Gohsei) and APG 325N (Cognis) and Surfactant 10G (Arch Chemical) surfactants in a ratio by weight of 96.5/2.9/0.6 was coated over the gelatin and poly(vinyl alcohol)/polyurethane layers at a dry coverage of 1 μm. The coatings were dried thoroughly by forced air heat after application of the coating solutions.

Control Element C-2

This element was the same as C-1 except that the overcoat layer was a 7% solution of Z-320 acetoactylated poly(vinyl alcohol) (Nippon Gohsei), a 40% dispersion of Witcobond ® UCX-244 polyurethane (Witco Corp), and APG 325N (Cognis) and Surfactant 10G (Arch Chemical) surfactants, in a ratio by weight of 80.5/16.0/2.9/0.6.

Element 1

This element was the same as C-1 except that the overcoat layer contained 4.4 wt. % sodium metabisulfite and 1.1 wt. % ammonium chloride.

Element 2

This element was the same as C-1 except that the overcoat layer contained 6.4 wt. % sodium metabisulfite and 4.4 wt. % ammonium chloride.

Element 3

This element was the same as C-1 except that the overcoat layer contained 4.4 wt. % sodium metabisulfite and 4.4 wt. % ammonium chloride.

Element 4

This element was the same as C-2 except that the overcoat layer contained 1.9 wt. % sodium metabisulfite and 1.9 wt. % ammonium chloride.

Element 5

This element was the same as C-2 except that the overcoat layer contained 3.7 wt. % sodium metabisulfite and 3.7 wt. % ammonium chloride.

Incubation

The above elements were conditioned in a humidity chamber at 22° C. and 50% RH for 24 hours and placed in sealed foil-lined bags. The bags were then incubated at 49° C. for 1 week. Another set of elements was held at ambient conditions for 1 week.

Printing

The incubated and non-incubated elements above were printed at ambient conditions using an Encad Novajet 850® printer with Encad GX® inks, having catalog numbers: Cyan (212668-00), Magenta (212669-00), Yellow (212670-00), Black (212671-00). The test target consisted of cyan, magenta, yellow, and black patches at 100% ink laydown; red, green, and blue patches at 200%; and a composite black patch consisting of cyan, magenta, and yellow at 300% laydown.

Testing

After printing, the gloss of the color patches of the incubated and non-incubated elements were read using a Gardiner micro-TRI-gloss reflectometer at 20°. The gloss measurements of the individual patches in each element were averaged. The differences in gloss between the incubated and non-incubated elements are shown in Table 1 below. The difference in gloss is an indication of the keeping stability of the elements. The less negative the number, the more stable the coating.

TABLE 1

| Element | Difference in Gloss |
|---|---|
| C-1 | −7.7 |
| 1 | −3.2 |
| 2 | −4.3 |
| 3 | −2.5 |
| C-2 | −30.8 |
| 4 | −13.3 |
| 5 | −16.1 |

The above results show that when subjected to conditions of high temperature and humidity, the addition of sodium metabisulfite and ammonium chloride at varying levels improves gloss stability as compared to the control element without those salts.

The invention has been described in detail with particular reference to certain preferred embodiments thereof, but it will be understood that variations and modifications can be effected within the spirit and scope of the invention.

What is claimed is:

1. An ink jet printing method, comprising the steps of:

A) providing an ink jet printer that is responsive to digital data signals;

B) loading said printer with an ink jet recording element comprising a support having thereon, in order, a hydrophilic absorbing layer and a polymeric overcoat layer comprising a derivitized poly(vinyl alcohol) having at least one hydroxyl group replaced by ether or ester groups, said polymeric overcoat layer also containing a sulfurous acid salt and an ammonium salt having the formula $$(NR^1R^2R^3R^4)Z.$$

where $R^1$, $R^2$, $R^3$, and $R^4$ hydrogen or alkyl, with the proviso that at least one $R^1$, $R^2$, $R^3$, or $R^4$ is hydrogen; and Z is a counterion;

C) loading said printer with an ink jet ink; and

D) printing on said image-receiving layer using said ink jet ink in response to said digital data signals.

2. The method of claim 1 wherein said derivitized poly (vinyl alcohol) comprises acetoacetylated poly(vinyl alcohol).

3. The method of claim 2 wherein said polymeric overcoat layer also contains a latex polymer.

4. The method of claim 2 wherein said acetoacetylated poly(vinyl alcohol) has a degree of saponification of 80 to 100%.

5. The method of claim 2 wherein said acetoacetylated poly(vinyl alcohol) has a degree of modification of 2.5 to 15 mol %.

6. The method of claim 2 wherein said acetoacetylated poly(vinyl alcohol) has a molecular weight of 15,000 to 150,000.

7. The method of claim 2 wherein said polymeric overcoat layer also contains a polyurethane dispersion.

8. The method of claim 7 wherein the weight ratio of derivitized poly(vinyl alcohol) to polyurethane dispersion is between 50:50 and 95:5.

9. The method of claim 1 further comprising at least one hydrophilic inner layer between said hydrophilic absorbing layer and said polymeric overcoat layer.

10. The method of claim 9 wherein said inner layer is present in a dry thickness amount of between 0.5 and 5 μm.

11. The method of claim 9 wherein said inner layer comprises a poly(vinyl alcohol).

12. The method of claim 11 wherein said inner layer further contains a latex polymer.

13. The method of claim 11 wherein said inner layer further comprises a polyurethane dispersion.

14. The method of claim 1 wherein said hydrophilic absorbing layer further comprises gelatin.

15. The method of claim 1 wherein said sulfurous acid salt is a sulfite, hydrogen sulfite, or pyrosulfite.

16. The method of claim 15 wherein said sulfurous acid salt is sodium metabisulfite.

17. The method of claim 1 wherein said ammonium salt is ammonium chloride.

18. The method of claim 1 wherein said overcoat layer contains from about 1 to about 8 wt. % of said sulfurous acid salt and from about 1 to about 8 wt. % of said ammonium salt.

19. An ink jet punting method, comprising the steps of:

A) providing an ink jet printer that is responsive to digital data signals;

B) loading said printer with an ink jet recording element comprising a support having thereon, in order, a hydrophilic absorbing layer and a polymeric overcoat layer comprising a derivatized poly(vinyl alcohol) having at least one bydroxyl group replaced by ether or ester groups, said polymeric overcoat layer also containing from about 1 to about 8 wt. % of a sulfurous acid salt and from about 1 to about 8 wt. % of an ammonium salt;

C) loading said printer with an ink jet ink; and

D) printing on said image-receiving layer using said ink jet ink in response to said digital data signals.

20. The method of claim 19 further comprising at least one hydrophilic inner layer between said hydrophilic absorbing layer and said polymeric overcoat layer.

* * * * *